US009764339B2

(12) United States Patent
Yu

(10) Patent No.: US 9,764,339 B2
(45) Date of Patent: Sep. 19, 2017

(54) BUTTON SWITCHING TYPE HANDHELD SHOWER HEAD

(71) Applicant: Sinyu Technology (Fujian) Co., Ltd., Zhangzhou, Fujian Province (CN)

(72) Inventor: Zhangjun Yu, Zhangzhou (CN)

(73) Assignee: SINYU TECHNOLOGY (FUJIAN) CO., LTD., Fujian (CN)

( * ) Notice: Subject to any disclaimer, the term of this patent is extended or adjusted under 35 U.S.C. 154(b) by 0 days.

(21) Appl. No.: 15/023,364

(22) PCT Filed: Oct. 11, 2013

(86) PCT No.: PCT/CN2013/085044
§ 371 (c)(1),
(2) Date: Mar. 18, 2016

(87) PCT Pub. No.: WO2015/051530
PCT Pub. Date: Apr. 16, 2015

(65) Prior Publication Data
US 2016/0214122 A1 Jul. 28, 2016

(51) Int. Cl.
*B05B 1/18* (2006.01)
*B05B 1/16* (2006.01)
*B05B 12/00* (2006.01)

(52) U.S. Cl.
CPC ..... *B05B 1/18* (2013.01); *B05B 1/1636* (2013.01); *B05B 12/002* (2013.01)

(58) Field of Classification Search
CPC ..... B05B 1/1636; B05B 1/18; B05B 1/1609; B05B 12/002
USPC ..... 239/443, 447, 448
See application file for complete search history.

(56) References Cited

U.S. PATENT DOCUMENTS 4,254,914 A * 3/1981 Shames ..... B05B 1/1636 239/222.17
8,020,786 B2 * 9/2011 Lo ..... B05B 1/1609 239/237
8,113,442 B2 * 2/2012 Li ..... B05B 1/1636 239/11
8,177,147 B2 * 5/2012 Engel ..... B05B 1/1654 239/393
8,632,023 B2 * 1/2014 Miller ..... B05B 1/1636 239/443
9,427,749 B2 * 8/2016 Zhou ..... B05B 1/1636

* cited by examiner

*Primary Examiner* — Alexander Valvis
(74) *Attorney, Agent, or Firm* — Leong C. Lei

(57) ABSTRACT

A button switching type handheld shower head includes a water diversion seat between a body and a panel and a water diversion body at a side of the water diversion seat. A guiding groove and a bevel are formed in the inner wall of a center hole of the water diversion body. A first guiding bar is formed on the switching shaft. A switching sheet and a spring are sleeved on the switching shaft. A second guiding bar is formed at the center of the switching sheet. A guiding bevel is formed on the second guiding bar corresponding to the bevel. A turning sheet is pivoted in the body, an executing end is connected with the rear end of the switching shaft, and an operation end right faces the top of a button. The button is installed on a handle of the body and extends out of the body.

3 Claims, 5 Drawing Sheets

BUTTON SWITCHING TYPE HANDHELD SHOWER HEAD

BACKGROUND OF THE INVENTION

1. Field of the Invention

The present invention relates to a shower head structure, and more particularly to a button switching type handheld shower head.

2. Description of the Prior Art

Nowadays, handheld shower heads on the markets are developed to have different water discharging functions by rotating a panel. Some of the shower heads use one or more buttons to control the water discharging functions. It is inconvenient for use. Accordingly, the inventor of the present invention has devoted himself based on his many years of practical experiences to solve these problems.

SUMMARY OF THE INVENTION

The primary object of the present invention is to provide a button switching type handheld shower head. The shower head can control multiple water discharging functions through one button, and the switching operation can be achieved more conveniently.

In order to achieve the aforesaid object, the button switching type handheld shower head of the preset invention comprises a body, a panel, a water diversion seat, a water diversion body, a switching shaft, a switching sheet, a spring, a connecting piece, a turning sheet, and a button. The water diversion seat is installed between the body and the panel. The water diversion seat has functional water channels corresponding to functional water outlets of the panel. The water diversion body is installed at a side of the water diversion seat. The water diversion body is formed with functional water diversion holes corresponding to the functional water channels of the water diversion seat. The water diversion body has a center hole. An inner wall of the center hole of the water diversion body is formed with a guiding groove and a bevel. A front end of a switching shaft is inserted into the center hole of the water diversion body. The switching shaft is formed with a first guiding bar to match with the guiding groove. The switching sheet and the spring are sleeved on the switching shaft. The switching sheet is attached to a side of the water diversion body by means of the elasticity of the spring. The switching sheet is formed with a switching hole. The switch sheet is rotatable to align the switching hole with one of the functional water diversion holes. A center of the switching sheet is formed with a second guiding bar to match with the guiding groove. The second guiding bar is formed with a guiding bevel corresponding to the bevel. The turning sheet is pivoted in the body. An executing end of the turning sheet is connected with a rear end of the switching shaft through the connecting piece. An operation end of the turning sheet faces a top of the button. The button is installed on a handle of the body and extends out of the body.

Preferably, the body is formed with a body front lid. The body front lid and the body are assembled to form the handle. An inlet tube is provided and installed in the handle. The body front lid and the inlet tube are formed with installation holes. The button is installed in the two installation holes. A lower end of the button is exposed out of the installation hole of the body front lid. An upper end of the button is inserted into the installation hole of the inlet tube.

Preferably, the body or the inlet tube is provided with a press member. The press member has a U shape. The press member is located between the button and the turning sheet. The operation end of the turning sheet faces a center of the U-shaped press member. A center of the top of the button is provided with a push plate inserted in the center of the U-shaped press member.

Preferably, the turning sheet has an L shape. The L-shaped turning sheet has an angled portion pivoted on the body or the inlet tube. The operation end of the L-shaped turning sheet faces the top of the button. The executing end of the L-shaped turning sheet is inserted and connected to a rear end of the connecting piece. A front end of the connecting piece is formed two forked pieces. The two forked pieces are configured to clamp two sides of the rear end of the switching shaft and pivotally connected with the switching shaft.

Preferably, one side of the switching shaft, close to the water diversion body, is formed with first axial teeth. One side of the switching sheet, close to the water diversion body, is formed with second axial teeth. The first axial teeth mesh with the second axial teeth, such that the switching sheet is radially positioned on the switching shaft.

When in use, the button is pressed to turn the turning sheet. The switching shaft and the switching sheet are driven by the connecting piece to compress the spring to move rearward. The second guiding bar of the switching sheet is moved out of the guiding groove. The switching hole of the switching sheet is moved away from the initial aligned water diversion hole. The button is released. The switching shaft and the switching sheet, under the restoring force of the spring, are moved forward. The guiding bevel of the second guiding bar of the switching sheet cooperates with the bevel of the center hole of the water diversion body. With the aid of water pressure, the switching sheet is turned a corresponding angle, and the second guiding bar cooperates with the guiding groove again. At this time, the switching hole of the switching sheet is aligned with another water diversion hole for switching a different function.

Embodiments of the present invention will now be described, by way of example only, with reference to the accompanying drawings.

DETAILED DESCRIPTION OF THE PREFERRED EMBODIMENTS

Figure 1:
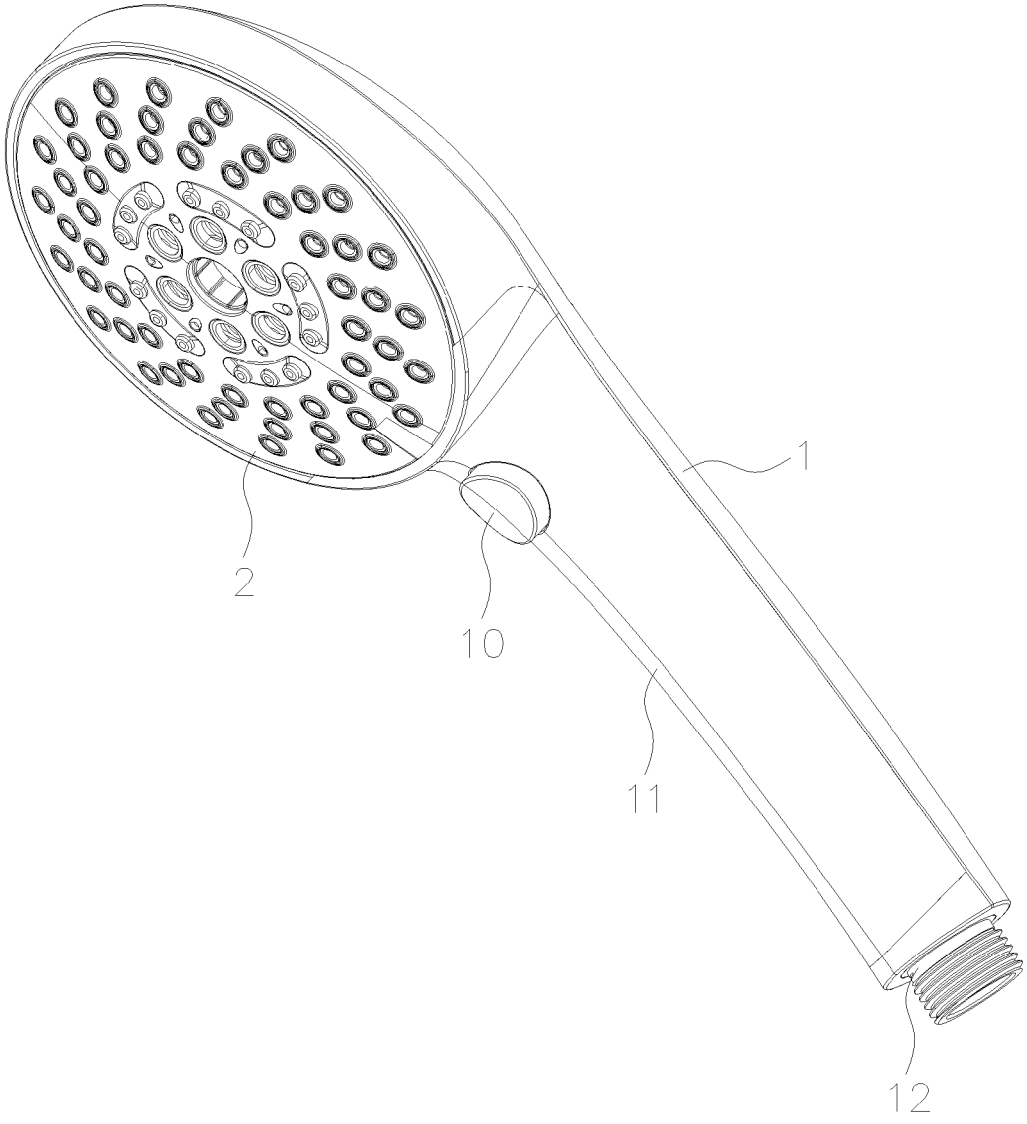
FIG. 1 is a perspective view of the present invention.
Figure 2:
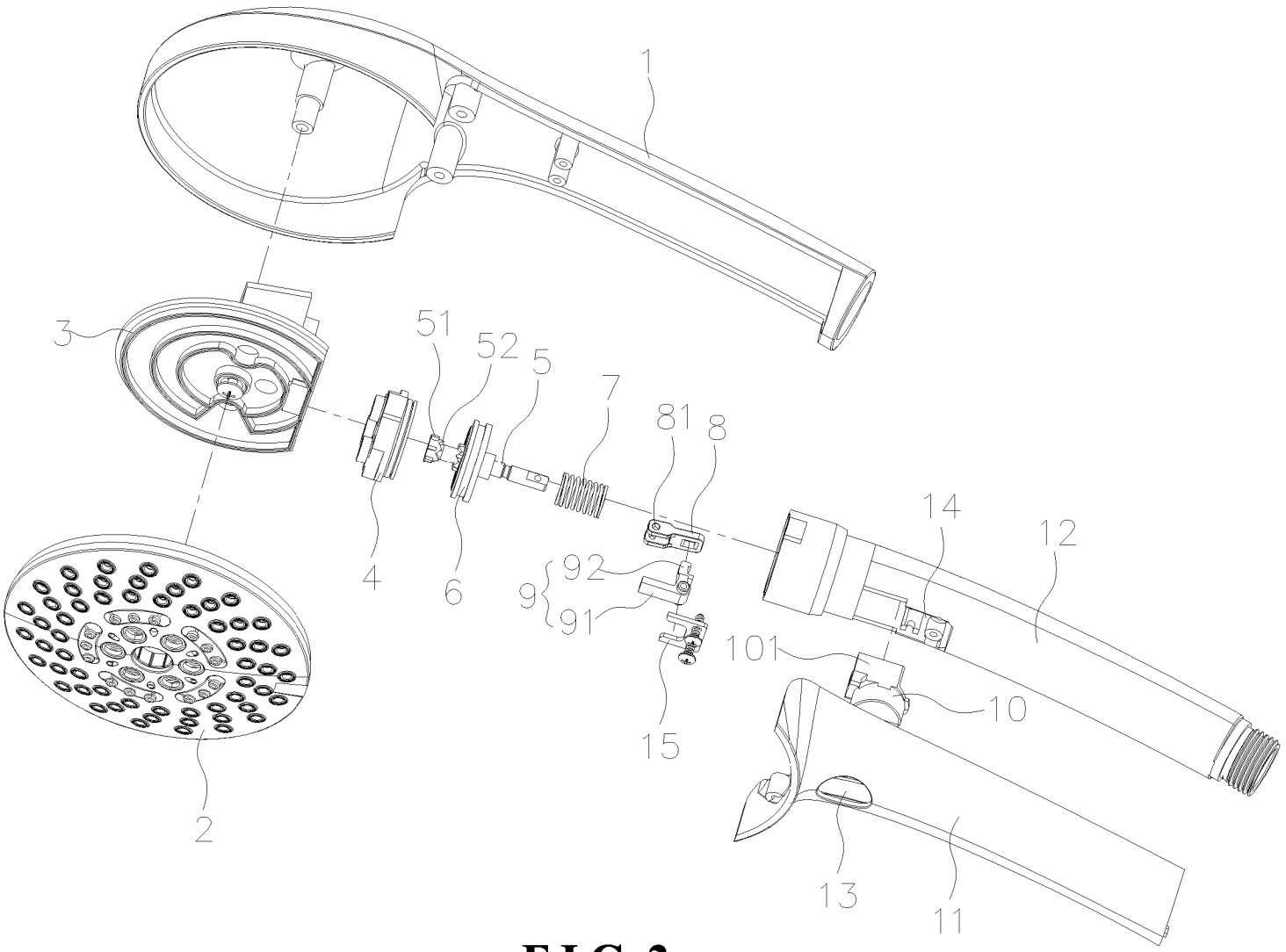
FIG. 2 is an exploded view of the present invention.
Figure 3:
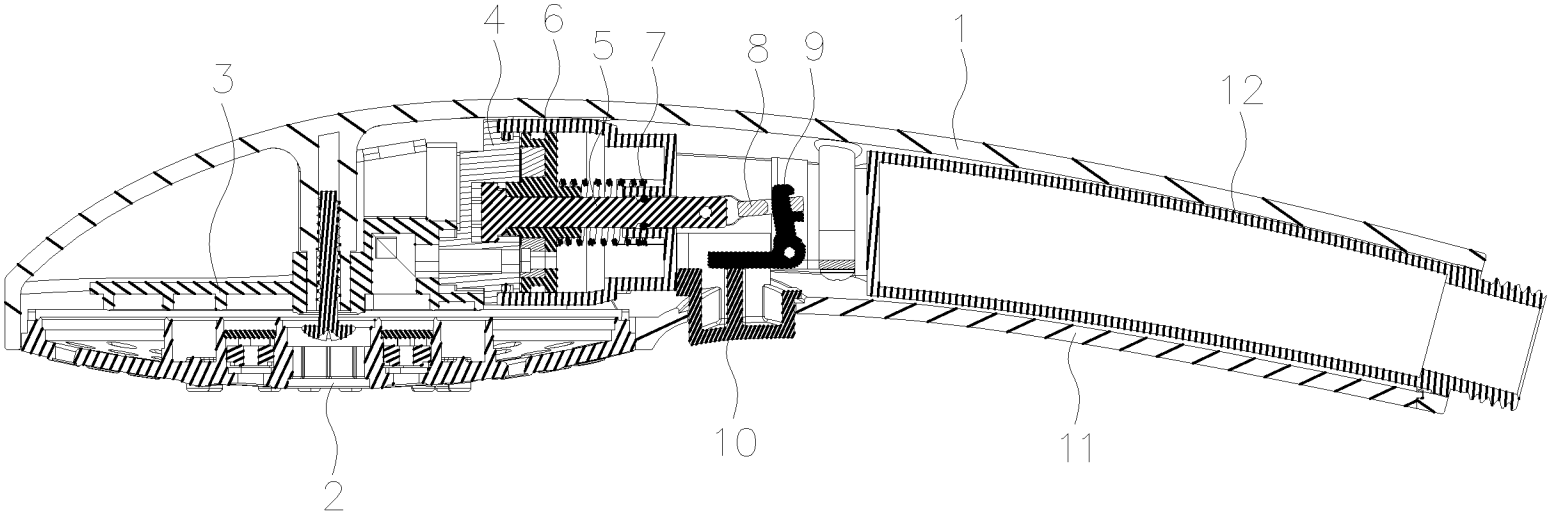
FIG. 3 is a sectional view of the present invention.
Figure 4:
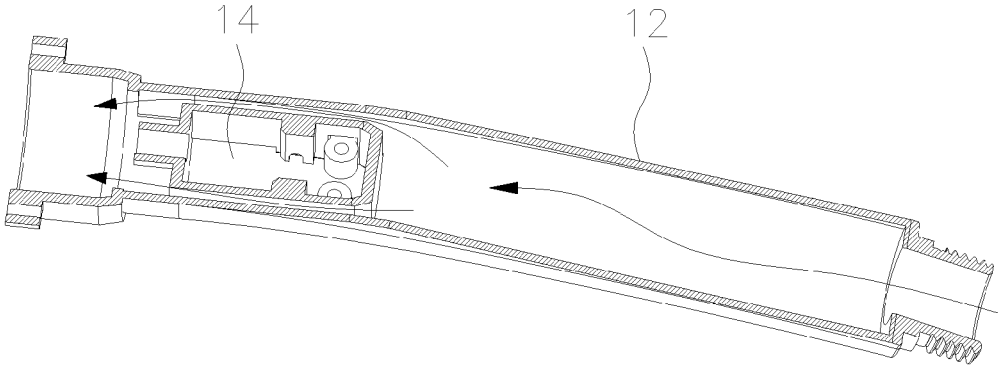
FIG. 4 is a sectional view of the inlet tube of the present invention.
Figure 5:
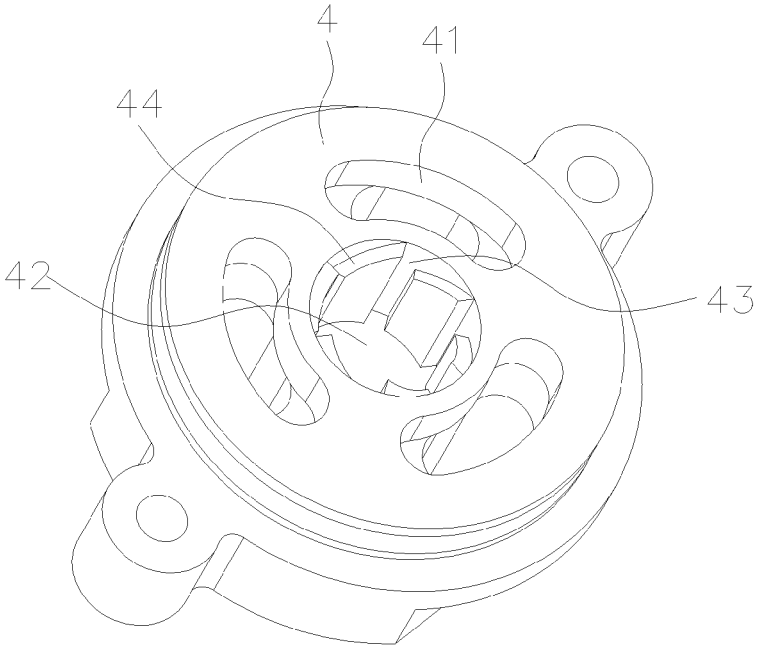
FIG. 5 is a perspective view of the water diversion body of the present invention.
Figure 6:
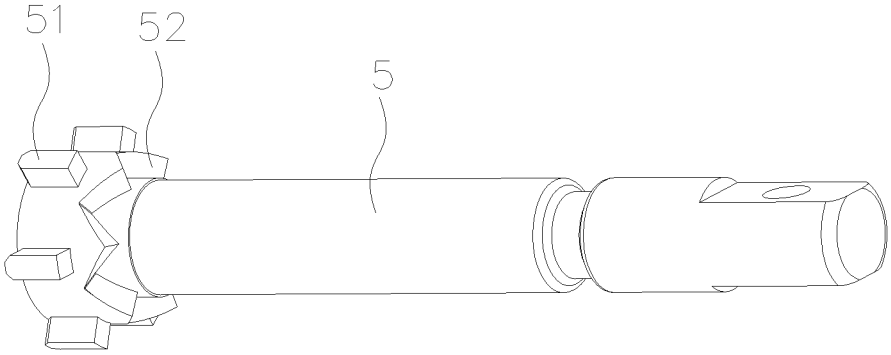
FIG. 6 is a perspective view of the switching shaft of the present invention.
Figure 7:
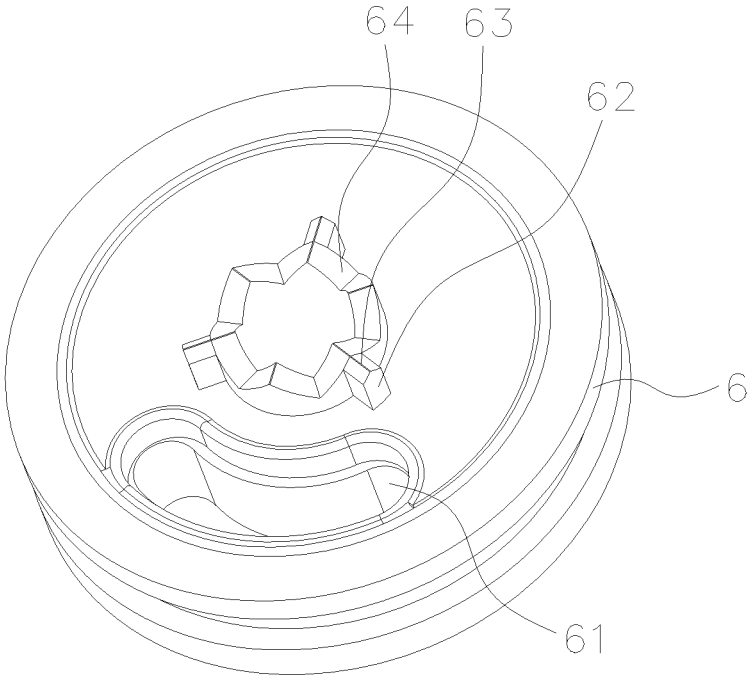
FIG. 7 is a perspective view of the switching sheet of the present invention.

FIG. 1 through FIG. 6 shows a preferred embodiment of the present invention.

A button switching type handheld shower head comprises a body 1, a panel 2, a water diversion seat 3, a water diversion body 4, a switching shaft 5, a switching sheet 6, a spring 7, a connecting piece 8, a turning sheet 9, and a button 10.

In order to assemble the components conveniently, the body 1 is formed with a body front lid 11. The body front lid 11 and the body 1 are assembled to form a handle. An inlet tube 12 is provided and installed in the handle.

The water diversion seat 3 is installed between the body 1 and the panel 2. The water diversion seat 3 has functional water channels corresponding to functional water outlets of the panel 2, which has the same configuration as a common multi-function shower head.

The water diversion body 4 is installed at a side of the water diversion seat 3, which has the same configuration as a common multi-function shower head. The water diversion body 4 is formed with functional water diversion holes 41 corresponding to the functional water channels of the water diversion seat 3 for switching the water route conveniently. The water diversion body 4 has a center hole 42. An inner wall of the center hole 42 of the water diversion body 4 is formed with a guiding groove 43 and a bevel 44.

A front end of a switching shaft 5 is inserted into the center hole 42 of the water diversion body 4. The switching shaft 5 is formed with a first guiding bar 51 thereon to match with the guiding groove 43.

The switching sheet 6 and the spring 7 are sleeved on the switching shaft 5. The switching sheet 6 is attached to a side of the water diversion body 4 by means of the elasticity of the spring 7. The switching sheet 6 is formed with a switching hole 61. The switch sheet 6 can be turned to align the switching hole 61 with one of the functional water diversion holes (41) for switching the water route. The center of the switching sheet 6 is formed with a second guiding bar 62 to match with the guiding groove 43. The second guiding bar 62 is formed with a guiding bevel 63 corresponding to the bevel 44. For a precise switch operation, one side of the switching shaft 5, close to the water diversion body 4, is formed with first axial teeth 52, and one side of the switching sheet 6, close to the water diversion body 4, is formed with second axial teeth 62. The first axial teeth 52 mesh with the second axial teeth 64, such that the switching sheet 6 is radially positioned on the switching shaft 5.

A front end of the connecting piece 8 is connected with a rear end of the switching shaft 5. A rear end of the connecting piece 8 is connected with an executing end of the turning sheet 9. The turning sheet 9 is pivoted in the body 1 (or the inlet tube 12). An operation end 92 of the turning sheet 9 right faces the top of the button 10. For a precise and stable transmission, the turning sheet 9 has an L shape. The L-shaped turning sheet 9 has an angled portion pivoted on the body 1 or the inlet tube 12. The operation end 92 of the L-shaped turning sheet 9 right faces the top of the button 10. The executing end 91 of the L-shaped turning sheet 9 is inserted and connected to the rear end of the connecting piece 8. The front end of the connecting piece 8 is formed two forked pieces 81. The two forked pieces 81 are configured to clamp two sides of the rear end of the switching shaft 5 and pivotally connected with the switching shaft 5.

The button 10 is installed on the handle of the body 1 and extends out of the body 1. In this embodiment, the body front lid 11 and the inlet tube 12 are formed with installation holes 13, 14. The button 10 is installed in the two installation holes 13, 14. A lower end of the button 10 is exposed out of the installation hole 13 of the body front lid 11, and an upper end of the button 10 is inserted into the installation hole 14 of the inlet tube 12. For a stable and precise transmission, the body 1 or the inlet tube 12 is provided with a press member 15. The press member 15 has a U shape. The press member 15 is located between the button 10 and the turning sheet 9. The operation end 92 of the turning sheet 9 right faces the center of the U-shaped press member 15. The center of the top of the button 10 is provided with a push plate 101 inserted in the center of the U-shaped press member 15. The push plate 101 right faces the operation end 92 of the turning sheet 9.

During use, when the button 10 is not pressed, under the action of the spring 7, the switching shaft 5 and the switching sheet 6 are moved forward. The first guiding bar 51 and the second guiding bar 62 are matched with the guiding groove 43. The water diversion body 4 and the switching shaft 5 are radially positioned to the switching sheet 6. The switching hole 61 of the switching sheet 6 is aligned with one or two functional water diversion holes 41 of the water diversion body 4 for a corresponding functional discharging.

If the user wants to switch the outflow function, the button 10 is pressed to turn the turning sheet 9. The switching shaft 5 and the switching sheet 6 are driven by the connecting piece 8 to compress the spring 7 to move rearward. The second guiding bar 62 of the switching sheet 6 is moved out of the guiding groove 43. The switching hole 61 of the switching sheet 6 is moved away from the initial aligned water diversion hole 41. The button 10 is released. The switching shaft 5 and the switching sheet 6, under the restoring force of the spring 7, are moved forward. The guiding bevel 63 of the second guiding bar 62 of the switching sheet 6 cooperates with the bevel 44 of the center hole 42 of the water diversion body 4. With the aid of water pressure, the switching sheet 6 is turned a corresponding angle, and the second guiding bar 62 cooperates with the guiding groove 43 again. At this time, the switching hole 61 of the switching sheet 6 is aligned with another water diversion hole 61 for switching a different function.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A button switching type handheld shower head, comprising a body, a panel, a water diversion seat, a water diversion body, a switching shaft, a switching sheet, a spring, a connecting piece, a turning sheet, and a button; the water diversion seat being installed between the body and the panel, the water diversion seat having functional water channels corresponding to functional water outlets of the panel; the water diversion body being installed at a side of the water diversion seat, the water diversion body being formed with functional water diversion holes corresponding to the functional water channels of the water diversion seat, the water diversion body having a center hole, an inner wall of the center hole of the water diversion body being formed with a guiding groove and a bevel; a front end of a switching shaft being inserted into the center hole of the water diversion body, the switching shaft being formed with a first guiding bar to match with the guiding groove; the switching sheet and the spring being sleeved on the switching shaft, the switching sheet being attached to a side of the water diversion body by means of elasticity of the spring, the switching sheet being formed with a switching hole, the switch sheet being rotatable to align the switching hole with one of the functional water diversion holes, a center of the switching sheet being formed with a second guiding bar to match with the guiding groove, the second guiding bar being formed with a guiding bevel corresponding to the bevel; the turning sheet being pivoted in the body, an executing end of the turning sheet being connected with a rear end of the switching shaft through the connecting piece, an operation end of the turning sheet faces a top of the button; and the button being installed on a handle of the body and extending out of the body, wherein the body is formed with a body front lid, the body front lid and the body are assembled to form the handle, an inlet tube is provided and installed in the handle, the body front lid is formed with a first installation hole, the inlet tube is formed with a second installation hole, a lower end of the button is exposed out of the first installation hole of the body front lid, and an upper end of the button is inserted into the second installation hole of the inlet tube, and one of the body and the inlet tube is provided with a press member, the press member has a U shape, the press member is located between the button and the turning sheet, the operation end of the turning sheet faces a center of the U-shaped press member, and a center of the top of the button is provided with a push plate inserted in the center of the U-shaped press member.

2. The button switching type handheld shower head as claimed in claim 1, wherein the turning sheet has an L shape, the L-shaped turning sheet has an angled portion pivoted on the body or the inlet tube, the operation end of the L-shaped turning sheet faces the top of the button, the executing end of the L-shaped turning sheet is inserted and connected to a rear end of the connecting piece, a front end of the connecting piece is formed two forked pieces, and the two forked pieces are configured to clamp two sides of the rear end of the switching shaft and pivotally connected with the switching shaft.

3. The button switching type handheld shower head as claimed in claim 1, wherein one side of the switching shaft, close to the water diversion body, is formed with first axial teeth, one side of the switching sheet, close to the water diversion body, is formed with second axial teeth, the first axial teeth mesh with the second axial teeth, such that the switching sheet is radially positioned on the switching shaft.

* * * * *